US010925343B2

(12) United States Patent
Sandy et al.

(10) Patent No.: US 10,925,343 B2
(45) Date of Patent: Feb. 23, 2021

(54) CLOSURE FOR AN ARTICLE OF FOOTWEAR

(71) Applicant: NIKE, Inc., Beaverton, OR (US)

(72) Inventors: Chad W. Sandy, Portland, OR (US); Justin R. Taylor, Portland, OR (US); Alvaro L. Henz, Portland, OR (US); Jeffrey S. To, Portland, OR (US); Precious Hannah, Aloha, OR (US)

(73) Assignee: NIKE, Inc., Beaverton, OR (US)

( * ) Notice: Subject to any disclaimer, the term of this patent is extended or adjusted under 35 U.S.C. 154(b) by 81 days.

(21) Appl. No.: 15/994,119

(22) Filed: May 31, 2018

(65) Prior Publication Data

US 2019/0365017 A1 Dec. 5, 2019

(51) Int. Cl.

| | |
|---|---|
| ***A43B 3/26*** | (2006.01) |
| ***A43B 3/30*** | (2006.01) |
| ***A43B 3/00*** | (2006.01) |
| ***A41F 1/00*** | (2006.01) |
| ***A43B 23/24*** | (2006.01) |
| ***A43C 11/00*** | (2006.01) |
| ***A43C 1/00*** | (2006.01) |
| ***A43C 1/02*** | (2006.01) |

(52) U.S. Cl.

CPC ..... *A43B 3/0036* (2013.01); *A41F 1/002* (2013.01); *A43B 3/26* (2013.01); *A43B 3/30* (2013.01); *A43B 23/24* (2013.01); *A43C 1/00* (2013.01); *A43C 1/02* (2013.01); *A43C 11/002* (2013.01); *A43C 11/008* (2013.01)

(58) Field of Classification Search

CPC ..... A43B 3/0073; A43B 3/0036; A43B 5/008; A43C 1/00; A43C 1/02; A43C 11/008; A43C 11/1493

See application file for complete search history.

(56) References Cited

U.S. PATENT DOCUMENTS

| | | | | |
|---|---|---|---|---|
| 2,991,561 A | | 7/1961 | Moore et al. | |
| 4,081,916 A | | 4/1978 | Salisbury | |
| 4,414,761 A | * | 11/1983 | Mahood | A43C 1/00 24/712 |
| 5,027,482 A | | 7/1991 | Torppey | |
| 5,240,418 A | | 8/1993 | Silverman et al. | |
| 5,357,691 A | * | 10/1994 | Hyde | A43B 23/26 36/50.1 |
| 5,416,987 A | | 5/1995 | Bemis et al. | |
| D379,029 S | | 5/1997 | Ruiz | |

(Continued)

*Primary Examiner* — Sharon M Prange
*Assistant Examiner* — Erick I Lopez
(74) *Attorney, Agent, or Firm* — Quinn IP Law

(57) ABSTRACT

An article of footwear includes a sole structure and an upper coupled with the sole structure. The upper has a first side portion, a second side portion separated from the first side portion by a throat opening, and a closure for selectively coupling the first side portion to the second side portion. The closure includes a closure panel and a plurality of laces each extending between a respective first end and a respective second end. The first end of each of the plurality of laces is directly secured to the first side portion of the upper and the second end of each of the plurality of laces is directly secured to the unitary closure panel. A selective and reusable fastener is further provided to couple the closure panel to the second side panel of the upper.

10 Claims, 4 Drawing Sheets

(56) References Cited

U.S. PATENT DOCUMENTS

| | | | | |
|---|---|---|---|---|
| 5,907,912 | A * | 6/1999 | Alaimo | A43C 11/008 36/50.1 |
| 6,474,000 | B2 * | 11/2002 | Burt | A43B 7/12 36/50.1 |
| 6,568,104 | B2 | 5/2003 | Liu | |
| 6,941,683 | B2 * | 9/2005 | Freed | A43C 1/003 24/712 |
| 6,968,638 | B2 | 11/2005 | Gonzalez Palacio | |
| 7,487,603 | B2 * | 2/2009 | Davis | A43B 1/0081 36/50.1 |
| 7,552,547 | B2 | 6/2009 | Calderone | |
| 7,765,721 | B2 * | 8/2010 | Hentz, III | A43C 11/004 36/50.1 |
| 8,869,432 | B1 | 10/2014 | Koo | |
| 9,750,309 | B2 | 9/2017 | Xanthos | |
| 9,756,903 | B1 * | 9/2017 | Koo | A43C 11/002 |
| 2008/0201986 | A1 | 8/2008 | Hentz et al. | |
| 2010/0313445 | A1 * | 12/2010 | Hochdoerffer | A43B 1/0054 36/50.1 |

* cited by examiner

CLOSURE FOR AN ARTICLE OF FOOTWEAR

TECHNICAL FIELD

The present disclosure relates generally to a closure for providing a tension fit in an article of footwear such as a child's shoe.

BACKGROUND

Articles of footwear generally include two primary elements: an upper and a sole. The upper is often formed from a plurality of material elements (e.g., textiles, polymer sheet layers, foam layers, leather, synthetic leather) that are stitched or adhesively bonded together to form a void on the interior of the footwear for comfortably and securely receiving a foot. More particularly, the upper forms a structure that extends over instep and toe areas of the foot, along medial and lateral sides of the foot, and around a heel area of the foot. In many designs, the upper may also incorporate a lacing system to adjust the fit of the footwear, as well as permitting entry and removal of the foot from the void within the upper.

The sole may be constructed to provide stability and cushioning. The sole may include an outsole, a midsole and an insole. The midsole provides support and cushioning while the outsole provides improved traction with the ground. The insole may provide increased comfort for the foot.

DETAILED DESCRIPTION

Figure 1:
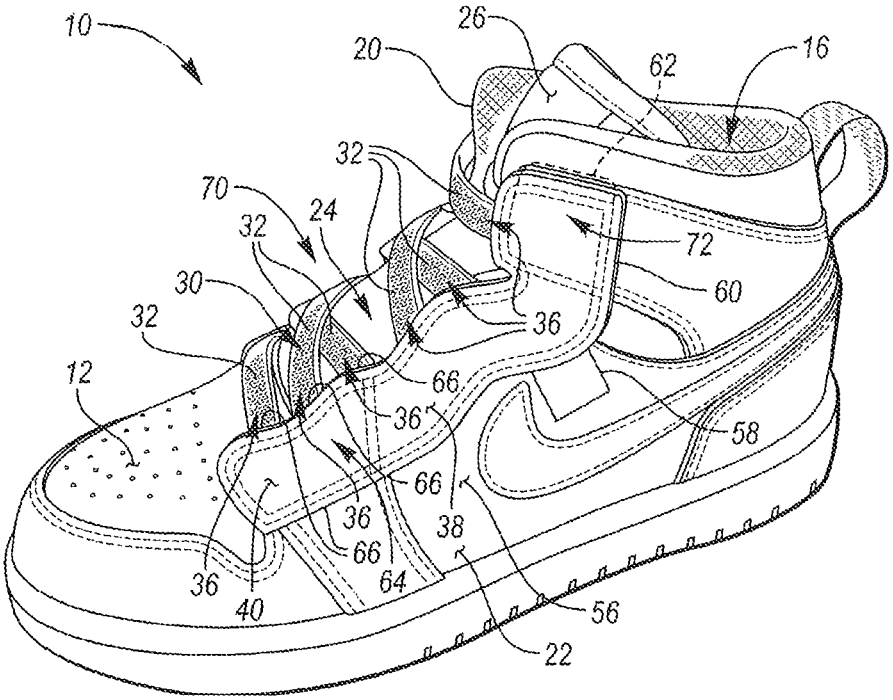
FIG. 1 is a schematic side perspective view of a first side of a high-top athletic shoe with a closure panel secured to a side portion of the upper.

The present embodiments discussed below are directed to an article of footwear, and more specifically an upper for an article of footwear that includes a selectively and reusably securable closure for providing a tension fit about the foot of a wearer. The upper may generally include a first side portion and a second side portion that each extend on a different one of a medial and lateral side of the article and/or wearer's foot when worn. The first side portion and second side portion may be separated by a throat opening, and the closure may selectively couple the first side portion to the second side portion across the throat opening.

The closure may generally include a unitary closure panel and a plurality of laces each extending between the closure panel and the first side portion of the upper. Each of the plurality of laces may extend between a respective first end and a respective second end. The first end of each of the plurality of laces may be directly and permanently secured to the first side portion of the upper. The second end of each of the plurality of laces may be directly and permanently secured to the unitary closure panel. In this manner, the unitary closure panel is permanently coupled to the upper only via the plurality of laces.

A fastener, such as a touch fastener, may be positioned to enable repeatable selective attachment between the closure panel and the second side portion of the upper. The fastener may include a first fastener portion provided on the closure panel, and a second fastener portion provided on an outer surface of the second side portion of the upper. The first fastener portion is configured to selectively couple with the first fastener portion to secure the closure panel to the second side portion of the upper. In some embodiments, the fastener may be a hook-and-loop fastener.

To facilitate proper alignment of the closure panel on the second side portion of the upper, in an embodiment, the closure panel and the second fastener portion may have complimentary, non-rectangular shapes. These shapes may, for example include one or more polygonal portions that each comprise a plurality of linear edges. In some embodiments, alignment may be aided by including an alignment indicia on one or both of the closure panel and the second side portion of the upper. For example, in one embodiment, the second fastener portion and the unitary closure panel each include a common alignment indicia. In another embodiment, only the second fastener portion may include the alignment indicia. In still another embodiment, the second fastener portion and/or second side portion of the upper may include an alignment indicia, and the closure panel may include an aperture positioned such that the alignment indicia is visible through the aperture when the closure panel is secured to the second side portion of the upper.

In one configuration, the unitary closure panel may comprise an outer layer and an inner layer secured to the outer layer. The inner layer may further comprise the first fastener portion of the touch fastener. To provide for robust permanent securing of the laces to the closure panel, the second end of each of the plurality of laces may be directly secured between the inner layer and the outer layer of the closure panel. In some embodiments, the outer layer of the closure panel is formed from a similar material as at least a portion of the second side portion of the upper. Additionally, to aid in providing a tension fit, each of the plurality of laces may comprise an elastomeric material that permits the respective laces to each stretch between the first end and the second end. In some embodiments, the tension fit may be further aided by including a tongue substantially disposed between the first side portion and the second side portion of the upper that is elastically secured to the sole structure via a plurality of elastic gores that each extend between an edge of the tongue and an edge of the sole structure.

The designs described herein may eliminate the need for any adjustable laces. As such, in some embodiments, the upper of the presently described article of footwear may be characterized by an absence of an adjustable lace. Likewise, the closure panel may be characterized by an absence of an eyelet for receiving an adjustable lace.

"A," "an," "the," "at least one," and "one or more" are used interchangeably to indicate that at least one of the item is present; a plurality of such items may be present unless the context clearly indicates otherwise. All numerical values of parameters (e.g., of quantities or conditions) in this specification, including the appended claims, are to be understood as being modified in all instances by the term "about" whether or not "about" actually appears before the numerical value. "About" indicates that the stated numerical value allows some slight imprecision (with some approach to exactness in the value; about or reasonably close to the value; nearly). If the imprecision provided by "about" is not otherwise understood in the art with this ordinary meaning, then "about" as used herein indicates at least variations that may arise from ordinary methods of measuring and using such parameters. In addition, disclosure of ranges includes disclosure of all values and further divided ranges within the entire range. Each value within a range and the endpoints of a range are hereby all disclosed as separate embodiment. The terms "comprises," "comprising," "including," and "having," are inclusive and therefore specify the presence of stated items, but do not preclude the presence of other items. As used in this specification, the term "or" includes any and all combinations of one or more of the listed items. When the terms first, second, third, etc. are used to differentiate various items from each other, these designations are merely for convenience and do not limit the items.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Furthermore, the terms "include," and "have," and any variations thereof, are intended to cover a non-exclusive inclusion, such that a process, method, system, article, device, or apparatus that comprises a list of elements is not necessarily limited to those elements, but may include other elements not expressly listed or inherent to such process, method, system, article, device, or apparatus.

Other features and aspects will become apparent by consideration of the following detailed description and accompanying drawings. Before any embodiments of the disclosure are explained in detail, it should be understood that the disclosure is not limited in its application to the details or construction and the arrangement of components as set forth in the following description or as illustrated in the drawings. The disclosure is capable of supporting other embodiments and of being practiced or of being carried out in various ways. It should be understood that the description of specific embodiments is not intended to limit the disclosure from covering all modifications, equivalents and alternatives falling within the spirit and scope of the disclosure. Also, it is to be understood that the phraseology and terminology used herein is for the purpose of description and should not be regarded as limiting.

Figure 2:
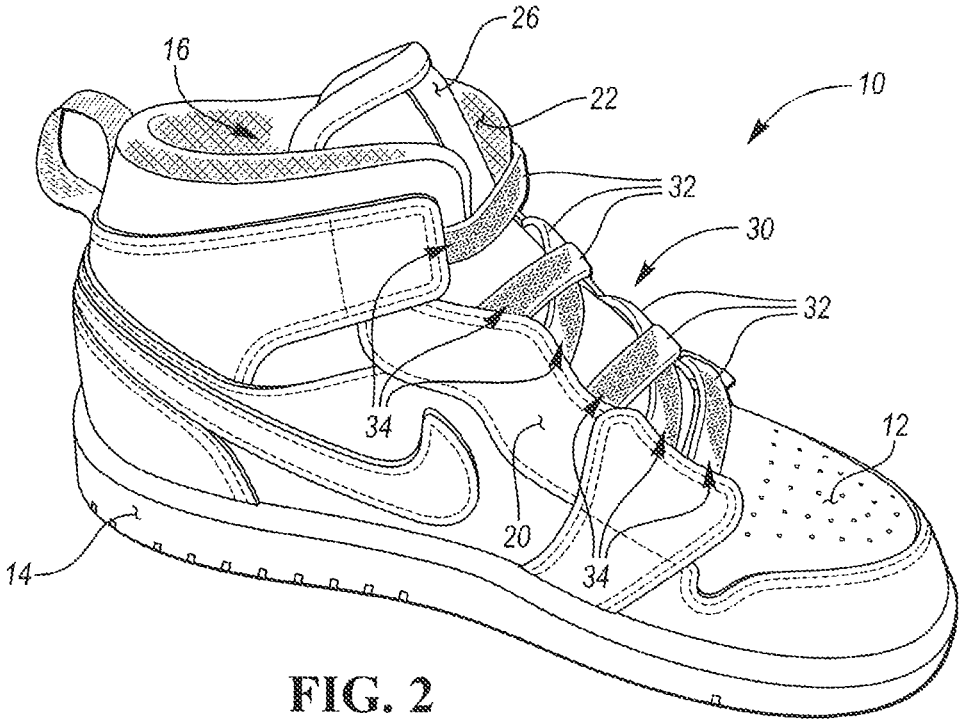
FIG. 2 is a schematic side perspective view of a second side of the high-top athletic shoe of FIG. 1.
Figure 3:
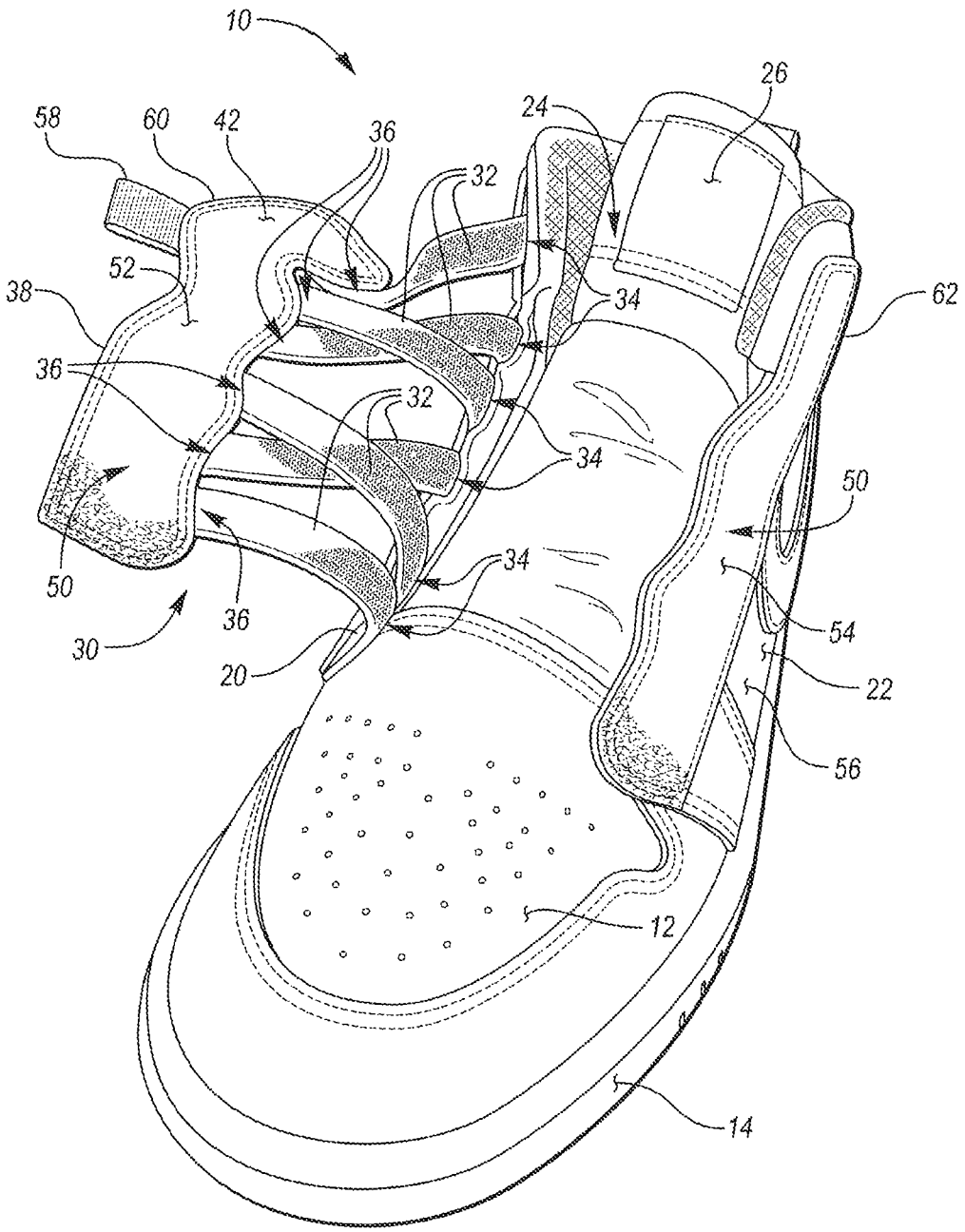
FIG. 3 is a schematic top perspective view of the high-top athletic shoe of FIG. 1, with the closure panel separated from the side portion of the upper.

Referring to the drawings, wherein like reference numerals are used to identify like or identical components in the various views, FIGS. 1-3 schematically illustrate an article of footwear 10 that includes an upper 12 coupled with a sole structure 14. In the current embodiment, the article of footwear 10 is shown in the form of a high-top athletic shoe, such as a basketball shoe. In other embodiments, however, an article incorporating the features described below could take the form of other kinds of footwear including, but not limited to, hiking boots, soccer shoes, football shoes, sneakers, running shoes, cross-training shoes, rugby shoes, basketball shoes, baseball shoes, and other kinds of shoes. Moreover, in some embodiments the disclosed provisions may be configured for use with various kinds of non-sports-related footwear, including, but not limited to, slippers, sandals, loafers, or other such designs/configurations.

As commonly understood, the upper 12 is a portion of the article of footwear 10 that defines an interior cavity 16 adapted to receive a foot of a wearer. For the purpose of consistency and clarity, the "interior" of a shoe refers to space that is occupied by a wearer's foot when the shoe is worn. The "inner side" of a panel or other shoe element refers to the face of that panel or element that is (or will be) oriented toward the shoe's interior in a completed shoe. The "outer side" or "exterior" of an element refers to the face of that element that is (or will be) oriented away from the shoe's interior in the completed shoe. In some cases, the inner side of an element may have other elements between that inner side and the interior in the completed shoe. Similarly, an outer side of an element may have other elements between that outer side and the space external to the completed shoe. Further, the terms "inward" and "inwardly" shall refer to the direction toward the interior of the shoe, and the terms "outward" and "outwardly" shall refer to the direction toward the exterior of the shoe.

In general, the upper 12 includes provisions to reduce any tendency of the foot to be pulled away from the upper during use. In some embodiments, the upper 12 may be configured to provide a 'tension fit' about a wearer's foot. As used herein, the term tension fit refers to a fit that ensures the upper is pulled against the foot at all times including on a lower side where the sole of the foot contacts a bottom portion of the upper 12. In some cases, a tension fit upper may be configured so that when no foot is present within the interior cavity 16, the interior cavity 16 has a volume that is smaller than the volume after a foot has been inserted. In other words, the upper 12 may be configured to stretch or expand as a foot is inserted. As discussed in further detail below, such a configuration may provide an upper 12 that 'stays with' the foot, and especially the sole of the foot, at all times during any activities (e.g., running, jumping, walking, etc.). A tension fit may or may not require stretching in the upper. In some cases, the upper 12 can be configured to stretch significantly when a foot is inserted. In other cases, however, the upper 12 may simply fit the foot very snugly without significant expansion.

The sole structure 14 may be permanently attached to one or more portions of upper 12 (for example, with adhesive, stitching, welding, or other suitable techniques) and may have a configuration that extends between upper 12 and the ground. For purposes of this disclosure, the term "permanently attached" shall refer to two components joined in a manner such that the components may not be readily separated (for example, without destroying one or both of the components). In addition, two components may be "permanently attached" by virtue of being integrally formed, for example, through a molding process.

The sole structure 14 may include provisions for attenuating ground reaction forces (i.e., cushioning and stabilizing the foot during vertical and horizontal loading). In addition, sole structure 14 may be configured to provide traction, impart stability, and control or limit various foot motions, such as pronation, supination, or other motions. For example, the disclosed concepts may be applicable to footwear configured for use on any of a variety of surfaces, including indoor surfaces or outdoor surfaces. In some embodiments, the sole structure 14 may be configured to provide traction and stability on hard indoor surfaces (such as hardwood), soft, natural turf surfaces, or on hard, artificial turf surfaces.

In different embodiments, the sole structure 14 may include different components, which may, individually or collectively, provide an article with a number of attributes, such as support, rigidity, flexibility, stability, cushioning, comfort, reduced weight, or other attributes. For example, the sole structure 14 may include an outsole, a midsole, a cushioning layer, and/or an insole. It may be appreciated however that the sole structure 14 is not limited to incorporating traditional sole components and may incorporate various different kinds of elements arranged at the outermost, inner most and intermediate 'layers', or locations, of the sole. Thus, the sole structure 14 can include an outer sole member or element, which may or may not coincide with a conventional 'outsole'. Likewise, the sole structure 14 may include an inner sole member or element, which may or may not be an 'insole'. Further, the sole structure 14 can include any number of intermediate and/or middle sole members or elements, which may or may not be a 'midsole'.

With continued reference to FIGS. 1-3, the upper 12 may generally include a first side portion 20 or first quarter, a second side portion 22 or second quarter, and a throat opening 24 that at least partially separates the first side portion 20 from the second side portion 22. The throat opening 24 may permit a wearer's foot to extend into the interior cavity 16 of the upper 12 while providing an ability to adjust the girth of the upper to create a tension fit. When worn, the first side portion 20 and second side portion 22 may at least partially extend on opposite medial and lateral sides of the wearer's foot. In some embodiments, a tongue 26 may be provided interior to the first side portion 20 and second side portion 22, and may extend across a portion of the throat opening 24 substantially between the first side portion 20 and second side portion 22.

The upper 12 may further include a closure 30 that is operative to secure the upper 12 about the wearer's foot. In the present design, the closure 30 may provide for easy ingress and egress from the shoe. Such a design may be particularly advantageous in a shoe intended for those with limited dexterous mobility, such as young children and the elderly.

As illustrated in FIGS. 1-3, the closure 30 may include a plurality of laces 32 that each extend between a respective first end 34 (best illustrated in FIGS. 2-3) and a respective second end 36 (best illustrated in FIGS. 1 and 3). The first end 34 of each of the plurality of laces 32 may be permanently secured to the first side portion 20, while the second end 36 of each of the plurality of laces 32 may be permanently secured to a closure panel 38 that is configured to be selectively and/or removably secured to the second side portion 22 of the upper 12. As illustrated in FIG. 3, the closure panel 38 is permanently secured to the upper 12 only via the plurality of laces 32. In an embodiment, the plurality of laces 32 may be formed from one or more an integral laces in which adjacent ones of the first ends 34 are connected, and in which adjacent ones of the second ends 36 are connected.

As shown in FIGS. 1 and 3, in an embodiment, the closure panel 38 may be a unitary closure panel 38 that may be permanently secured to at least 4, or 5, or 6 or more laces (of the plurality of laces 32). In some embodiments, the closure panel 38 may include at least two layers secured to each other: an outer layer 40 (shown in FIG. 1); and an inner layer 42. The outer layer 40 may be formed from a similar material as at least a portion of the second side portion 22 of the upper 12. For example, the outer layer 40 may be formed from a leather, synthetic leather, thermoplastic polyurethane (TPU), rubber, canvas, or other such material that is typically of the kind used to form the exterior portion of shoe uppers. As best illustrated in FIG. 3, in an embodiment, the second end 36 of each of the plurality of laces 32 may extend, and be secured between the outer layer 40 and the inner layer 42 of the closure panel 38. Such a design may provide a cleaner appearance, while ensuring a robust attachment between each of the laces 32 and the closure panel 38.

Referring to FIG. 3, a fastening feature 50 may be provided with the upper 12 to facilitate the selective and removable coupling between the closure panel 38 and the second side portion 22 of the upper 12. The fastening feature 50 may include a first fastener portion 52 provided on the closure panel 38 and a second fastener portion 54 provided on an outer surface 56 of the second side portion 22 of the upper 12. To secure the upper 12 about a wearer's foot, the first fastener portion 52 may be selectively coupled with the second fastener portion 54, such as by bringing the first fastener portion 52 into contact with the second fastener portion 54. In some embodiments, the inner layer 42 of the closure panel 38 may comprise the first fastener portion 52.

In one configuration, the fastening feature 50 (i.e., the first fastener portion 52 and the second fastener portion 54) may comprise a hook-and-loop fastener. As used herein, the term "hook-and-loop fastener" is expressly meant to include any of a variety of touch-type fasteners that operate on the basis of the mechanical engagement between a multitude of elements to provide non-permanent, reusable mechanical affixment between two complimentary surfaces. Examples of designs that may operate on this basis may include a plurality of hooks on a surface that mechanically engage with a plurality of loops provided on an opposing surface, a plurality of spaced protrusions that nest and engage into a complimentary receiving feature on an opposing surface, and a plurality of spaced stems on each surface that each have enlarged ends (i.e., wherein the enlarged ends of the first fastener portion 52 interlock with the enlarged ends of the second fastener portion 54). In another embodiment, the fastening feature 50 may comprise a magnetic fastening system in which the first and second fastener portions 52, 54 are a permanently magnetizable material, magnetized with rows of alternating poles so that the first and second fastener portions 52, 54 magnetically secure to one another. In some embodiments, the closure panel 38 may further include a pull tab 58 disposed on an opposite side from the plurality of laces 32 to aid the wearer in removing the closure panel 38 from the second side portion 22 of the upper 12.

Referring again to FIG. 1, in an embodiment, the closure panel 38 and the second fastener portion 54 may have outer perimeters 60, 62 that are complimentary, non-rectangular shapes. Such a design may provide for quick visual alignment between the closure panel and the second fastener portion 54, which may aid children and/or the elderly in properly securing their shoes. As shown in FIG. 1, in some configurations, the non-rectangular shapes may include at least a portion 64 that is substantially polygonal and includes a plurality of linear edges 66.

When used with a high-top athletic shoe, such as shown in FIG. 1, the closure 30 may be operative to provide a tension fit across both an instep portion 70 of the upper 12 and across an ankle collar portion 72 of the upper 12. In general, the instep portion 70 of the upper 12 may include the portion of the upper 12 that extends between approximately the ball of the wearer's foot and about the ankle portion of the wearer's foot. Conversely, the ankle collar 72 is the portion of the upper 12 that extends circumferentially around the wearer's ankle to provide additional lateral support. As shown in FIG. 1, in some high-top shoe embodiments, the closure panel 38 (and first and second fastener portion 52, 54) may extend along the throat opening 24 and across at least a portion of both the instep portion 70 and the ankle collar portion 72. In doing so, the closure 30 may provide a tension fit about the wearer's ankle as well as across the instep portion of their foot.

To further provide a tension fit across the upper 12, in some embodiments, some or all of the plurality of laces 32 may be formed, at least in part, from an elastomeric material that permits each respective lace to stretch between the first end 34 and the second end 36. In some embodiments, the elastomeric material may form a core of the respective lace, with a woven shell disposed about the core. In other embodiments, the elastomeric material may be directly woven into the lace itself. In general, the elasticity of the laces may be measured as a percent elongation when subject to a particular loading. In one embodiment, at least a portion of the plurality of laces 32 may experience greater than or equal to about 5% elongation when the respective lace is pulled along its length (i.e., between the first end 34 and the second end 36) with 40 kilograms force at a 500 millimeter per minute loading rate. In other embodiment, at least a portion of the plurality of laces 32 may experience greater than or equal to about 10% elongation, or greater than about 15% elongation, or even greater than about 20% elongation when the respective lace is pulled along its length with 40 kilograms force at a 500 millimeter per minute loading rate. In some embodiments, these 'elastic' laces may contrast with a relatively 'inelastic' first and second side portion 20, 22, which may experience less than or equal to about 5% elongation when the respective side portion is pulled with 40 kilograms force at a 500 millimeter per minute loading rate.

Figure 4:
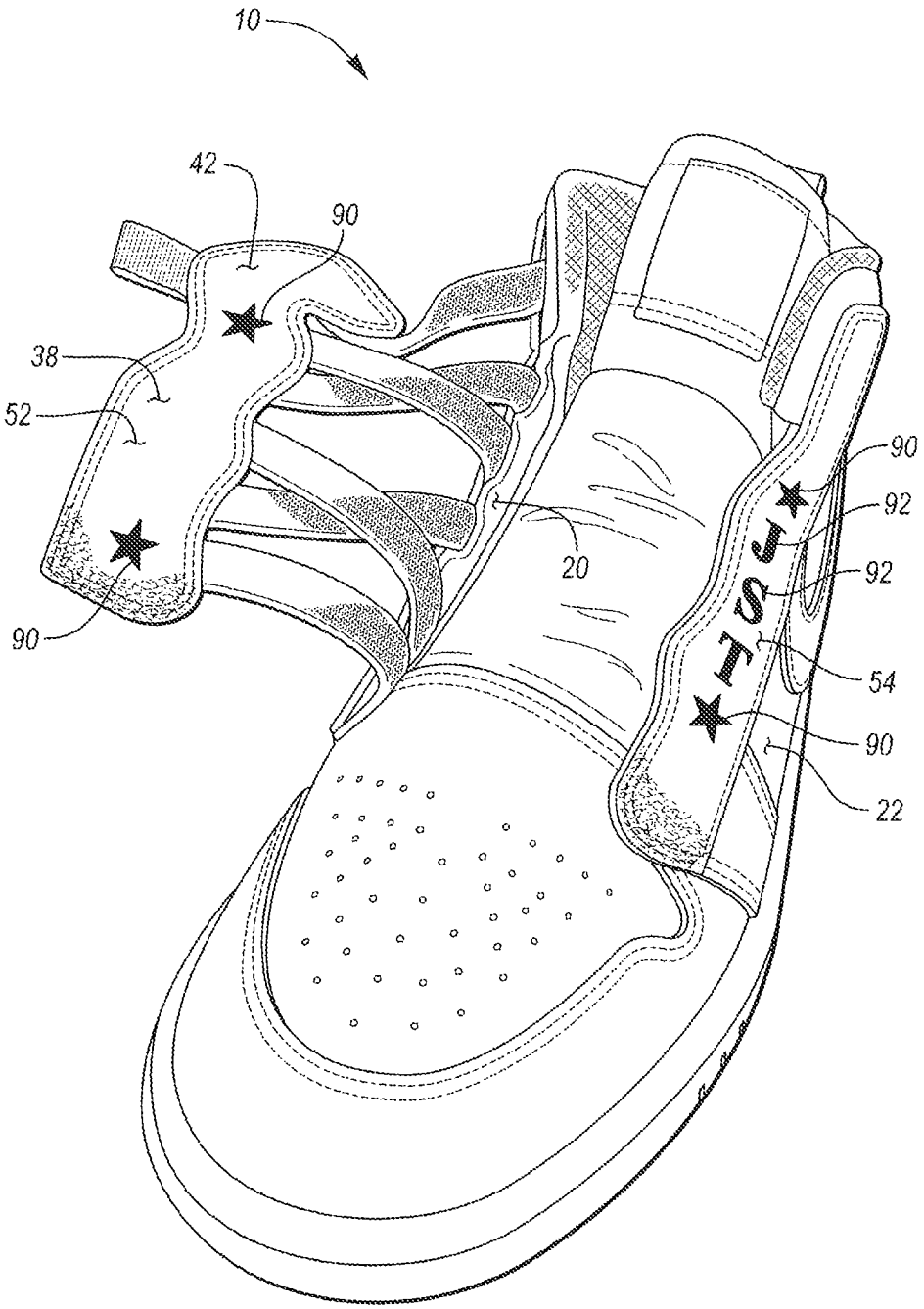
FIG. 4 is a schematic top perspective view of a high-top athletic shoe with a closure panel and side portion of the upper each including a plurality of alignment indicia.
Figure 5:
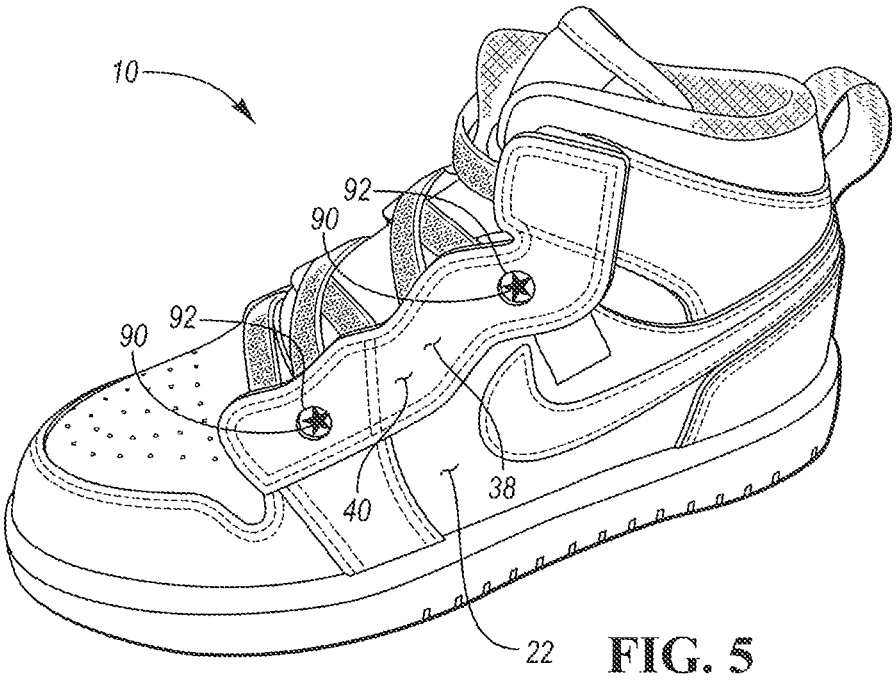
FIG. 5 is a schematic side perspective view of a first side of a high-top athletic shoe with a closure panel having an aperture for viewing one or more alignment indicia provided on a side panel of the upper.

Referring to FIGS. 4-5, in some embodiments, one or more additional alignment indicia 90 may be provided on the article of footwear 10 to aid in aligning the closure panel 38 and first fastener portion 52 with the second fastener portion 54. In particular, the alignment indicia 90 may provide a particular benefit for young children that are more adept at matching primitive shapes or graphical images than accurately securing shoes. In some embodiments, such as shown in FIG. 4, the alignment indicia 90 may be provided on both the closure panel 38 and on the second side portion 22. The alignment indicia 90 each may comprise a sequence of different indicia, such as further shown in FIG. 4. In such an embodiment, common indicia 90 may be overlaid on each other to provide a proper closure of the upper 12. In one embodiment, the sequence of indicia may be customizable and/or chosen by an end user. For example, upon ordering, such as via an internet ecommerce website, the end user may specify the alignment indicia, including, for example, the wearer's name or initials 92. In this manner, when used with young children, ownership may be easily recognized by examining the alignment indicia 90/initials 92.

In one embodiment, the alignment indicia 90 may be provided on at least one of the outer layer 40 of the closure panel 38 and the inner layer 42 of the closure panel 38 as well as on the second fastener portion 54. In other embodiments, the alignment indicia 90 may only be provided on the second fastener portion 54 (i.e., so that the indicia 90 must be covered when the closure panel 38 is secured in place). In some embodiments, the indicia 90 may be positively applied, such as via a dye or decal, however, in other embodiments, the indicia 90 may be negatively applied, such as by removing a negative image from a section of hooks or pile in a hook-and-loop fastener.

Referring to FIG. 5, in one embodiment, the alignment indicia 90 may be provided on at least one of the outer surface 56 of the second side panel 22 or the second fastener portion 54. Additionally, the closure panel 90 may include an aperture 92, notch, or cutout that may enable the alignment indicia 90 to be visible when the closure panel 90 is secured to the second side portion 22. In some configurations, the alignment indicia 90 visible through the aperture 92 may convey some information to the wearer or about the wearer's foot. For example, in some embodiments, the second side panel 22 may include a plurality of different alignment indicia 90. When the closure panel 38 is secured over top of the plurality of alignment indicia 90, one may be visible through the aperture 92 to inform the user, for example, about how tightly the strap is secured (i.e., a relative measure of the degree of the tension fit).

While the preceding description generally relates to a closure 30 for providing a tension fit in an upper 12 of an article of footwear, it should be appreciated that this closure 30 may eliminate the need for, and may operate without the inclusion of an adjustable lace or an eyelet for receiving an adjustable lace. In some embodiments, the upper 12 may specifically be characterized by an absence of an adjustable lace and the closure panel may be characterized by an absence of an eyelet for receiving an adjustable lace.

Figure 6:
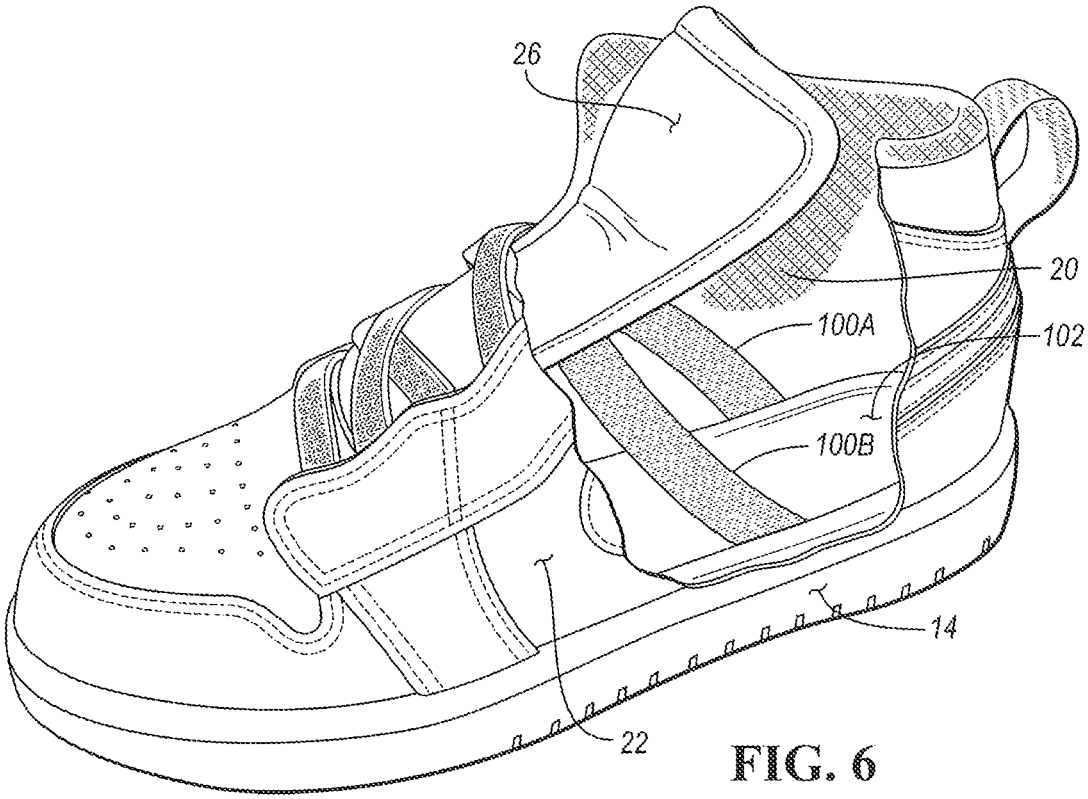
FIG. 6 is a schematic partial cut away side perspective view of a high-top athletic shoe with an elastic gore extending from each side of a tongue to an edge of the sole structure.

In some embodiments, the upper 12 may further provide a tension fit through the use of one or more elastic gores 100 that extend between an edge 102 of the tongue 26 and an edge 104 of the sole structure 14, such as shown in FIG. 6. In one embodiment, this design may include a first elastic gore 100A provided adjacent and interior to the first sidewall portion 20, and a second elastic gore 100B provided adjacent and interior to the second sidewall portion 22. The gores 100A, 100B may cooperate to elastically limit any outward deflection of the tongue during use.

Benefits, other advantages, and solutions to problems have been described with regard to specific embodiments. The benefits, advantages, solutions to problems, and any element or elements that may cause any benefit, advantage, or solution to occur or become more pronounced, however, are not to be construed as critical, required, or essential features or elements of any or all of the claims, unless such benefits, advantages, solutions, or elements are expressly stated in such claims.

The invention claimed is:

1. An article of footwear comprising:

an upper comprising:

a first side portion, a second side portion separated from the first side portion by a throat opening, and a closure for selectively coupling the first side portion to the second side portion across the throat opening; the closure including:

a unitary closure panel having a first fastener portion;

a plurality of laces each extending between a respective first end and a respective second end, wherein:

the first end of each of the plurality of laces is directly and permanently attached to the first side portion of the upper;

the second end of each of the plurality of laces is directly and permanently attached to the unitary closure panel; and the unitary closure panel is permanently coupled to the upper only via the plurality of laces; and a second fastener portion provided on an outer surface of the second side portion of the upper, the second fastener portion configured to selectively couple with the first fastener portion to secure the closure panel to the second side portion of the upper;

wherein the unitary closure panel comprises:

an outer layer, and an inner layer secured to the outer layer;

wherein the inner layer comprises the first fastener portion; and wherein the second end of each of the plurality of laces is directly secured between the inner layer and the outer layer of the closure panel.

2. The article of footwear of claim 1, wherein the first fastener portion and the second fastener portion together form a hook-and-loop fastener.

3. The article of footwear of claim 2, wherein the closure panel and the second fastener portion have complimentary, non-rectangular shapes to facilitate proper alignment of the closure panel on the second side portion of the upper.

4. The article of footwear of claim 3, wherein the complimentary, non-rectangular shapes each include a respective polygonal portion comprising a plurality of linear edges.

5. The article of footwear of claim 1, wherein the outer layer of the closure panel is formed from the same material as at least a portion of the second side portion of the upper.

6. The article of footwear of claim 1, wherein the second fastener portion and the unitary closure panel each include a common alignment indicia.

7. The article of footwear of claim 1, wherein the second fastener portion includes an alignment indicia, and wherein the unitary closure panel includes an aperture positioned such that the alignment indicia is visible through the aperture when the closure panel is secured to the second side portion of the upper.

8. The article of footwear of claim 1, wherein each of the plurality of laces comprises an elastomer to permit each of the plurality of laces to stretch between the first end and the second end.

9. The article of footwear of claim 1, wherein the upper lacks an adjustable lace; and wherein the closure panel lacks an eyelet for receiving an adjustable lace.

10. The article of footwear of claim 1, further comprising a tongue disposed between the first side portion and the second side portion of the upper, and a sole structure coupled to the upper; and wherein the tongue is secured to the sole structure via a plurality of elastic gores that each extend between an edge of the tongue and an edge of the sole structure.

* * * * *